US006366535B1

(12) United States Patent
Hartmann

(10) Patent No.: US 6,366,535 B1
(45) Date of Patent: Apr. 2, 2002

(54) APPARATUS FOR GENERATING ULTRASONIC FIELDS

(75) Inventor: Werner Hartmann, Grossenseebach (DE)

(73) Assignee: Siemens Aktiengesellschaft, Munich (DE)

( * ) Notice: Subject to any disclaimer, the term of this patent is extended or adjusted under 35 U.S.C. 154(b) by 0 days.

(21) Appl. No.: 09/539,240

(22) Filed: Mar. 30, 2000

Related U.S. Application Data

(63) Continuation of application No. PCT/DE98/02870, filed on Sep. 28, 1998.

(30) Foreign Application Priority Data

Sep. 30, 1997 (DE) ..... 197 43 336

(51) Int. Cl.[7] ..... G10K 15/06
(52) U.S. Cl. ..... 367/147
(58) Field of Search ..... 367/147, 142, 367/171

(56) References Cited

U.S. PATENT DOCUMENTS 3,688,562 A 9/1972 Munger et al. ..... 367/142
4,040,000 A 8/1977 Dwivedi ..... 367/142
4,764,906 A * 8/1988 Clements ..... 367/147
5,903,518 A * 5/1999 Benwell et al. ..... 367/147

FOREIGN PATENT DOCUMENTS

| | | |
|---|---|---|
| DE | 1 076 413 | 2/1960 |
| DE | 27 32 855 C2 | 1/1983 |
| EP | 0 336 086 | 10/1989 |
| EP | 0 567 038 A1 | 10/1993 |
| WO | WO-9917276 * | 4/1999 |

OTHER PUBLICATIONS

Derwent Abstract No. 414990, dated 1998.
Derwent Abstract No. 38741A, dated 1978.
Derwent Abstract No. 242498, dated 1989.

* cited by examiner

*Primary Examiner*—Daniel T. Pihulic
(74) *Attorney, Agent, or Firm*—Herbert L. Lerner; Laurence A. Greenberg; Werner H. Stemer

(57) ABSTRACT

The thermohydraulic principle is utilized for generating intensive ultrasonic fields. At least two electrodes which enclose a volume with an electrolyte are driven by a power pulse generator. The electrolyte volume to be heated by the electrical pulse is delimited to such an extent that the electrical power to be applied can be controlled by semiconductor switching elements.

13 Claims, 3 Drawing Sheets

APPARATUS FOR GENERATING ULTRASONIC FIELDS

CROSS-REFERENCE TO RELATED APPLICATION

This is a continuation of copending International Application PCT/DE98/02870, filed Sep. 28, 1998, which designated the United States.

BACKGROUND OF THE INVENTION

Field of the Invention

The invention relates to an apparatus for generating ultrasonic fields. The ultrasound is generated according to the thermohydraulic principle in liquids. The apparatus has at least two electrodes which enclose a volume with an electrolyte and are driven by a power pulse generator, and a sound transmitter surface.

Ultrasound is used in a wide variety of technological applications and, furthermore, especially in medicine. Examples of medical applications are imaging diagnosis methods in medicine, such as the ultrasonic examination of internal organs and of fetuses in pregnant women. Examples of general technology are the crack-fracture point localization of highly stressed parts or sonar methods.

Over and above the aforementioned applications, intensive focused ultrasonic fields, especially, have been used relatively recently in hypothermia methods in medical treatment and in surgery. Preconditions here include a high spatial resolution and good focusability. To those ends, it is necessary to generate high frequencies in the range above 1 MHz in conjunction with time-averaged sonic powers of a few watts up to a few 100 watts. The quality of the wavefront of the ultrasonic field is of great importance for the resolution and focus size.

Systems that have been introduced in practical applications predominantly utilize piezoelectric sound transducers, which are well suited to generating plane wavefronts. Focusing is thereby effected either by acoustic lenses or else by specific shaping of the sound transducers. Multidimensional arrays are also known, these having been developed for example as phase-controlled arrangements (phased arrays), in which the individual elements can be driven independently of one another in order to control the focus position and focus size in a targeted manner by changing electrical parameters.

The construction of the prior art assemblies is comparatively complex, and the service life of the sound transducers and the amplitudes that can be achieved leave something to be desired.

We have previously considered utilizing the thermohydraulic principle for generating intensive pressure pulses in liquids in order to generate ultrasonic wave fields. Information in that regard may be found in the commonly assigned published German patent application DE 19 702 593 A1 (not prior art). There, an electrolyte layer located between two electrodes is heated by a power pulse having a short duration, and an intensive pressure wave is radiated on account of the volumetric expansion of the electrolyte, associated with the heating, into the adjoining medium. The generation of individual pressure pulses according to this method makes it possible to generate plane wavefronts, or wavefronts shaped virtually as desired, with amplitudes of a number of MPa. However, this requires electrical pulses having peak powers in the neighborhood of about 100 MW.

SUMMARY OF THE INVENTION

It is accordingly an object of the invention to provide an apparatus for generating ultrasonic fields, which overcomes the disadvantages of the heretofore-known devices and methods of this general type and which, taking the previous development as a departure point, provides for a practical apparatus for generating ultrasonic fields.

With the foregoing and other objects in view there is provided, in accordance with the invention, an apparatus for generating ultrasonic fields by the thermohydraulic principle in liquids, comprising:

- at least two electrodes and a volume with an electrolyte enclosed by the electrodes;
- a power pulse generator connected to and driving the electrodes for heating the electrolyte volume;
- a sound transmitter surface; and
- semiconductor switching elements connected to the power pulse generator, whereby the electrolyte volume to be heated by an electrical pulse emitted by the power pulse generator is delimited to such an extent that an electrical power is controlled by the semiconductor switching elements.

In other words, the objects of the invention are satisfied in that the electrolyte volume to be heated by the electrical pulse is delimited to such an extent that the electrical power to be applied can be handled by semiconductor switching elements. In this case, the sound transmitter surface may preferably be provided either as a two-dimensional array with defined array elements or else as a one-and-a-half-dimensional arrangement of array elements.

The novel sound transmitter surface is structured in such a way that the individual elements have correspondingly small dimensions. Such elements are also referred to as "actels" (actuator-elements). An ultrasonic field having a high average power can thus be generated by the application of high pulse repetition rates. It is particularly advantageous that a ultrasonic wavefront can be shaped virtually as desired by targeted driving of the individual actels. The average heat loss converted in the electrolyte in the process can be dissipated by cooling, with the result that stable conditions are manifested over lengthy application periods.

In accordance with an added feature of the invention, the semiconductor switching elements are transistors or thyristors, and in particular field-effect transistors.

In accordance with an additional feature of the invention, the sound transmitter surface is structured as a two-dimensional array with individually driven defined array elements.

In accordance with another feature of the invention, the sound transmitter surface is structured as a phase-controlled array, with individual array elements having corresponding dimensions.

In accordance with a further feature of the invention, the sound transmitter surface is a one-and-a-half-dimensional arrangement of individually driven array elements for generating cylindrical wavefronts or spherical wavefronts.

In accordance with again an added feature of the invention, the sound transmitter surface is an array of individually driven array elements arranged on a curved surface.

In accordance with again an additional feature of the invention, there is provided an electronic drive unit for driving the array elements simultaneously, but independently of one another. In an alternative embodiment, the electronic drive unit drives the array elements with predeterminable time differences.

In accordance with again another feature of the invention, one of the electrodes is a carrier electrode and a portion of the electronic drive unit is integrated directly on the carrier electrode, such as driver transistors or a diode matrix.

In accordance with a concomitant feature of the invention, there are provided spacer elements for delimiting the electrolyte volume and, at the same time, for forming spacers between the electrodes.

Other features which are considered as characteristic for the invention are set forth in the appended claims.

Although the invention is illustrated and described herein as embodied in an apparatus for generating ultrasonic fields, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

BRIEF DESCRIPTION OF THE DRAWINGS

Identical or functionally equivalent parts are identified with corresponding reference symbols throughout the figures.

DESCRIPTION OF THE PREFERRED EMBODIMENTS

Figure 1:
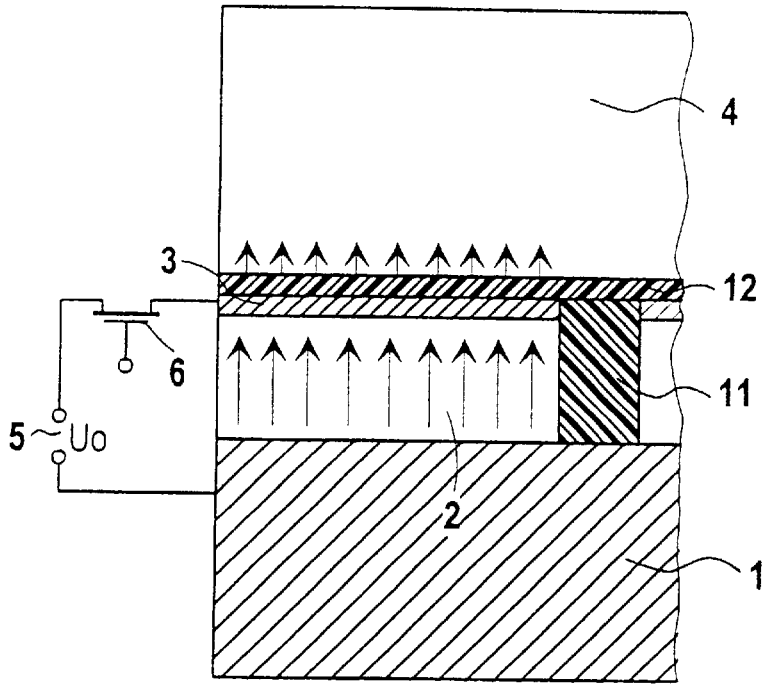
FIG. 1 is a partial schematic diagram illustrating the method of operation of an individual actel.

Referring now to the figures of the drawing in detail and first, particularly, to FIG. 1 thereof, there is shown a carrier electrode 1. The carrier electrode 1 is an acoustically hard, that is to say reflective, electrode. Disposed at a spacing distance from the carrier electrode 1 is a thin, acoustically transparent, diaphragm-like electrode 3, which forms the control electrode. An electrolyte 2 is introduced between the electrodes 1 and 2, the distance between the electrodes 1 and 3 and thus also the volume of the electrolyte 2 being defined by a spacer 11. The spacer may, as a web, delimit the electrolyte volume both laterally and/or peripherally.

In the present example, a support sheet 12 is fitted over the second electrode 3, the ultrasound that is generated passes from the support sheet into a sound propagation medium 4. A power pulse generator 5 is connected to the electrodes 1 and 3, with a switching element 6 connected in the circuit.

A so-called "actel" (actuator element) is defined by FIG. 1. When the electrolyte layer 3 is heated by a current pulse from the voltage source 5, the electrolyte 2 expands and, in the process, accelerates the metalized support sheet 12 into the propagation medium 4. As a result, an intensive sound wave is generated in the medium 4. A superposed sound wavefront is produced altogether by further adjoining actels.

The actel illustrated in FIG. 1 thus utilizes the thermoelectric principle described in detail in the above-noted German application DE 197 02 593 A1, which is herewith expressly incorporated by reference. There, the physical relationship between energy expenditure and generated pressure amplitude of an actel is described in detail.

Figure 2:
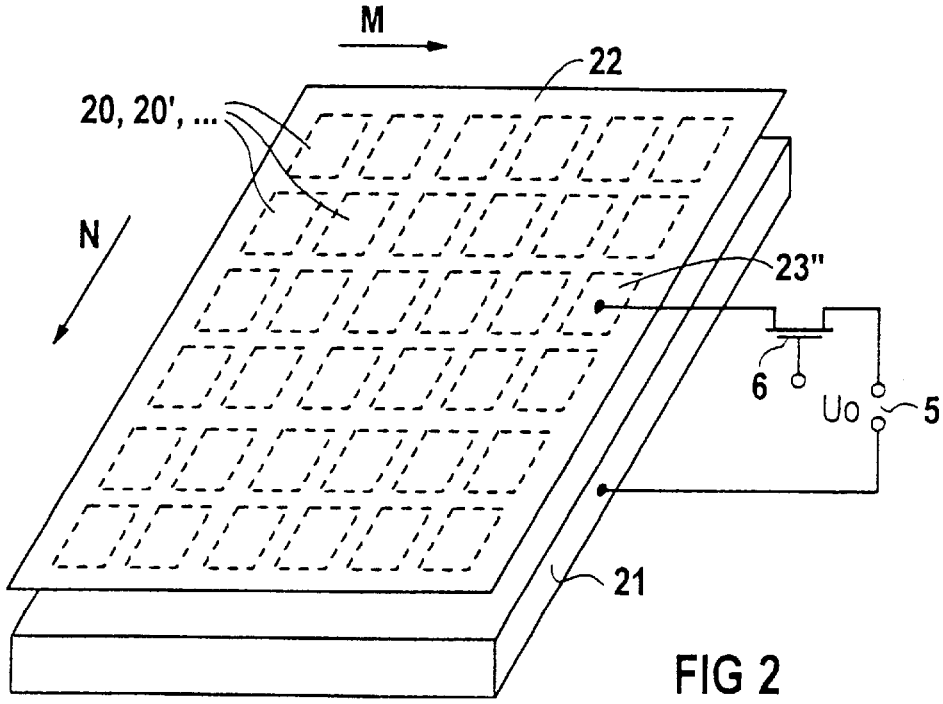
FIG. 2 is a perspective view of a plane arrangement of a two-dimensional array comprising N×M elements.

FIG. 2 illustrates a two-dimensional (2D) array comprising individual actels as shown in FIG. 1. A continuous carrier electrode 21 is provided with a support sheet 22 with individual metallic regions 23 as control electrodes. An electrolyte, which is not shown in FIG. 2, is arranged between the electrodes 21 and 23 in accordance with FIG. 1.

The discrete control electrodes 23" define individual actels 20, 20', 20" . . . which form a two-dimensional array comprising M columns and N rows. Given typical dimensions of an individual actel 20 of 1×1 mm side length and a distance between the electrodes 21 and 23 of 100 $\mu$m, a resistance of approximately 50Ω is obtained given an electrolyte conductivity of 0.5 Ωm. Consequently, given an energy input per actel of $\Delta E$=1 mJ, a peak power of 5 is required for a pulse duration of 0.4 $\mu$s. In this case, the current is about 10 A at a voltage of 500 V.

These requirements can be met by state-of-the-art, customary semiconductor switching elements, such as transistors or thyristors. By way of example, the switching element may be a field-effect transistor in FIG. 1. Other semiconductor switches are also possible. The pressure amplitude thus generated is typically about 1 bar when the electrolyte used is ethylene glycol, for example.

An arrangement as shown in FIG. 2 makes it possible to achieve for each actel an average power of 10 W at a pulse repetition rate of 10 kHz. In the case of the array arrangement, the individual actels 20, 20', 20" . . . must be driven simultaneously, but independently of one another. In a similar manner to the case of known flat screens, to that end it is possible, for example, to concomitantly integrate a portion of the drive electrodes with driver transistors or a diode matrix directly on the carrier electrode 21.

Referring now to FIGS. 3 to 6, there are illustrated so-called one-and-a-half-dimensional (1.5 D) arrays. The array shown in FIG. 3 serves to generate cylindrical wavefronts, for which purpose strip-type control electrodes 33, 33', 33" . . . on a common support sheet 32 are applied on the acoustically hard electrode 31 with electrolyte 2. The spacers for defining the distance between the carrier electrode 31 and the support sheet 32 with the control electrodes 33 metalized thereon are not shown in this figure. The electrolyte 2 is arranged continuously in this case, the control electrodes 33 each activating a narrowly delimited electrolyte volume for the purpose of generation. Slight crosstalk does not have an adverse effect.

Figure 5:
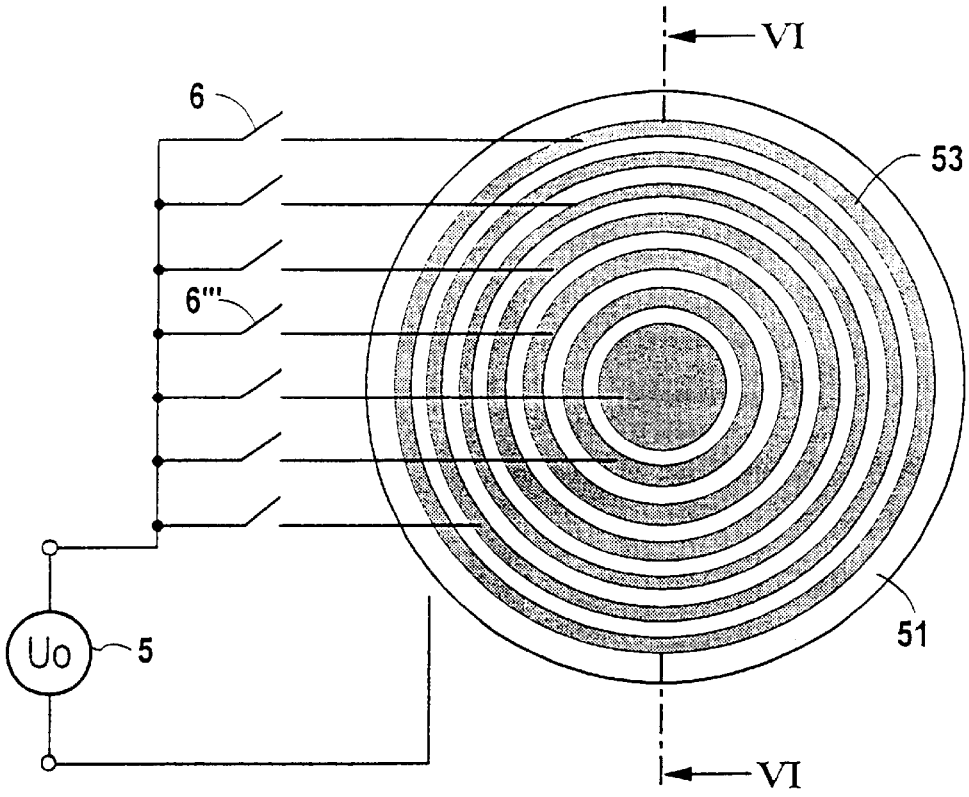
FIG. 5 is a diagrammatic view of a one-and-a-half-dimensional array for generating spherical wavefronts.

FIG. 5 illustrates a corresponding configuration for the generation of spherical wavefronts. There, the carrier electrode 51 is of circular design. The control electrodes 53, 53', 53" . . . which are metallized on the support sheet 52 are of annular design. The delimiting elements are again not illustrated, as in FIG. 3. The same applies correspondingly to the electrolyte layer.

Figure 3:
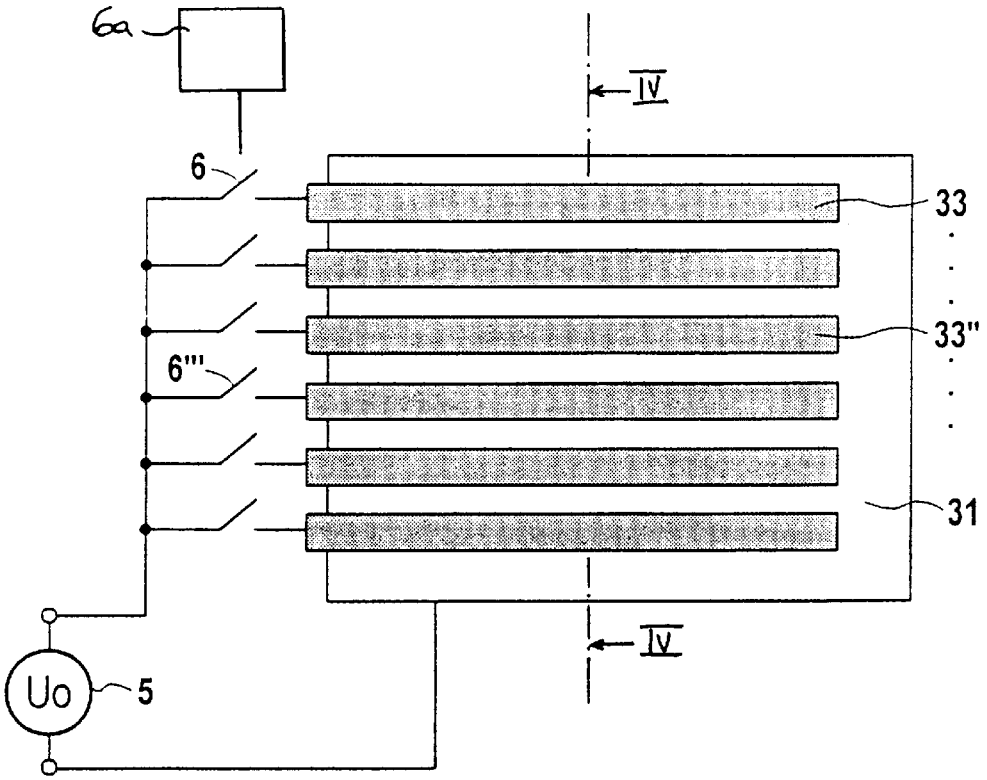
FIG. 3 is a plan view of a one-and-a-half dimensional array for generating cylindrical wavefronts.
Figure 4:
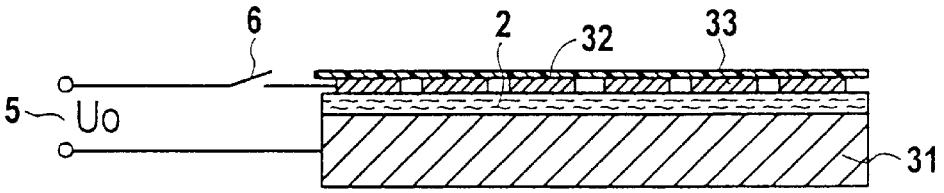
FIG. 4 is a sectional view taken along the line IV—IV through the assembly of FIG. 3.
Figure 6:
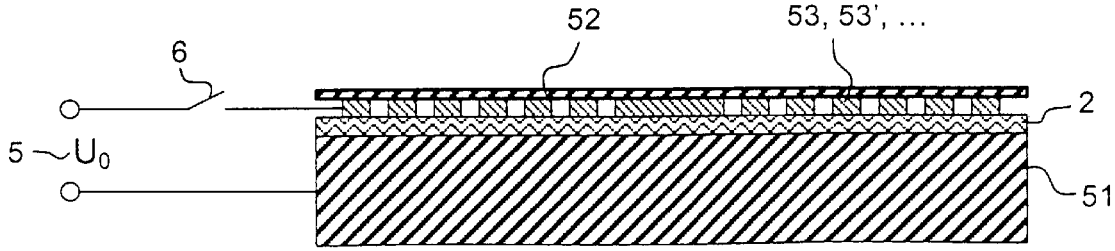
FIG. 6 is a sectional view taken along the line VI—VI through the assembly of FIG. 5.

The sectional illustrations of FIGS. 4 and 6 are very similar in the present case for the embodiments of FIG. 3 and FIG. 5. In both cases, the driving of the control electrodes is also identical, for which purpose individual switching elements 6, 6', 6" . . . are assigned in each case to the common voltage source 5.

The control electrodes 33 and 53 as shown in FIG. 3 and FIG. 5 respectively, can each be addressed separately and simultaneously via the switching elements 6, 6', 6" . . . Delayed driving of the individual control electrodes is also possible, the method of operation of a "phased array" being achieved, for example, by means of constant time differences. There is also indicated, in FIG. 3, an electronic drive unit 6*a* for driving the switching elements 6 in accordance with the required switching sequence.

It has been shown in detail specifically for an arrangement as shown in FIG. 3 with an actel length of 50 mm, a width of 1 mm and an electrode separation of 0.1 mm that, at an excitation frequency of 1.2 MHz, approximately 50 mJ are required per actel for a pressure amplitude of 1 bar. The peak current of about 500 A which is necessary for that can be borne by modern high-power semiconductors on account of the short pulse duration.

The latter statement also applies, in particular, to a configuration as shown in FIG. 5. In the case of the two arrangements as shown in FIGS. 3/4 or FIGS. 5/6, distinctly fewer actels and thus also fewer switching elements are required for the purpose of activation in comparison with FIG. 2.

Since plastic sheets metalized in the form of strips can be used in each case in the arrangements as shown in FIG. 2, FIGS. 3/4 and FIGS. 5/6, a cost-effective design is possible in all cases. Curved surfaces can also be constructed.

I claim:

1. An apparatus for generating ultrasonic fields by the thermohydraulic principle in liquids, comprising:

at least two electrodes and a volume with an electrolyte enclosed by said electrodes;

a power pulse generator connected to and driving said electrodes for heating said electrolyte volume;

a sound transmitter surface; and semiconductor switching elements connected to said power pulse generator, whereby said electrolyte volume to be heated by an electrical pulse emitted by said power pulse generator is delimited to such an extent that an electrical power is controlled by said semiconductor switching elements.

2. The apparatus according to claim 1, wherein said semiconductor switching elements are selected from the group consisting of transistors and thyristors.

3. The apparatus according to claim 1, wherein said semiconductor switching elements are field-effect transistors.

4. The apparatus according to claim 1, wherein said sound transmitter surface is structured as a two-dimensional array with individually driven defined array elements.

5. The apparatus according to claim 4, wherein said sound transmitter surface is structured as a phase-controlled array, with individual array elements having corresponding dimensions.

6. The apparatus according to claim 1, wherein said sound transmitter surface is a one-and-a-half-dimensional arrangement of individually driven array elements for generating cylindrical wavefronts.

7. The apparatus according to claim 1, wherein said sound transmitter surface is a one-and-a-half-dimensional arrangement of individually driven array elements for generating spherical wavefronts.

8. The apparatus according to claim 1, wherein said sound transmitter surface is an array of individually driven array elements arranged on a curved surface.

9. The apparatus according to claim 1, wherein said sound transmitter surface is an array of individually driven array elements, and an electronic drive unit for driving said array elements is connected to drive said array elements simultaneously, but independently of one another.

10. The apparatus according to claim 1, wherein said sound transmitter surface is an array of individually driven array elements, and an electronic drive unit for driving said array elements is connected to drive said array elements with predeterminable time differences.

11. The apparatus according to claim 10, wherein one of said electrodes is a carrier electrode and a portion of said electronic drive unit is integrated directly on said carrier electrode.

12. The apparatus according to claim 11, wherein said portion of said electronic drive unit includes components selected from the group consisting of driver transistors and a diode matrix.

13. The apparatus according to claim 1, which comprises spacer elements for delimiting said electrolyte volume and forming spacers between said electrodes.

* * * * *